US008925136B2

(12) United States Patent
Huybreckx

(10) Patent No.: US 8,925,136 B2
(45) Date of Patent: Jan. 6, 2015

(54) BRUSH CORE

(71) Applicant: KOTI Onroerend Goed b.v., Weert (NL)

(72) Inventor: Michel Jozef Rene Lambert Huybreckx, Weert (NL)

(73) Assignee: KOTI Onroerend Goed b.v. (NL)

( * ) Notice: Subject to any disclaimer, the term of this patent is extended or adjusted under 35 U.S.C. 154(b) by 0 days.

(21) Appl. No.: 13/893,914

(22) Filed: May 14, 2013

(65) Prior Publication Data

US 2013/0333135 A1 Dec. 19, 2013

(30) Foreign Application Priority Data

May 15, 2012 (NL) ..... 1039607

(51) Int. Cl.
*A46B 13/00* (2006.01)
*A46B 7/00* (2006.01)

(52) U.S. Cl.
CPC ..... *A46B 7/00* (2013.01); *A46B 13/001* (2013.01); *A46B 13/005* (2013.01); *A46B 2200/3066* (2013.01)
USPC ..... 15/183; 15/179

(58) Field of Classification Search
CPC ..... A46B 3/14; A46B 13/001; A46B 13/002; A46B 13/005; A46B 7/04; A46B 2200/3066
USPC ..... 15/179, 181–183, 230
See application file for complete search history.

(56) References Cited

U.S. PATENT DOCUMENTS 6,817,055 B1 * 11/2004 Ekholm ..... 15/183

FOREIGN PATENT DOCUMENTS

DE 20 2004 021149 U1 2/2007
WO WO 00/51461 A1 9/2000

OTHER PUBLICATIONS

Produktblad Bortskassetts, Aug. 7, 2008.

* cited by examiner

*Primary Examiner* — Shay Karls
(74) *Attorney, Agent, or Firm* — R. Neil Sudol; Henry D. Coleman

(57) ABSTRACT

The invention relates to an improved composite brush core (1) for taking up not shown brush elements between connecting blocks (16). The brush core (1) composed of double-walled segmental parts (5) comprises between the inner wall (10) and the outer wall (11) two type of ribs (12,13) placed in alternate position for coupling said parts (2) in an easy way. In this way a brush core is obtained with a flexible desired length (L) for mounting to brush machines of various types.

11 Claims, 1 Drawing Sheet

BRUSH CORE

BACKGROUND OF THE INVENTION

The invention relates to a brush core in the shape of a roller, being composed of double-walled segmental parts which after mounting are forming said roller, in which means are provided on the obtained outer surface for receiving brush elements, after which a cylindrical brush roller is obtained for mounting to a brush machine for brushing large surfaces.

Such a brush core is known by the Dutch Patent, titled "Composed brush core", No. NL 1 029 290, filed 12 Jan. 2012 for KOTI Onroerend Goed B.V. at Weert, Netherland. It concerns a brush core, being also composed of cilindrical, segmental parts. The wall of the cilinder is composed of an inner and an outer wall, being connected to each other by straight bend-proof ribs. The outer wall is shaped such that the brush elements can be directly longitudinal slid in the thin wall. Further the connection between said segmental shaped parts is obtained by block-shaped parts. Said block-shaped parts are provided with zigzag running support surfaces, in which in radial direction screwthread is present and which by means of screws are clamped onto each other. The known brush core has to be directly manufactured in the desired length of about 3 up to 5 m.

The known brush core, composed of cylindrical segmental parts, has disadvantages concerning the embodiment and the suitable mounting.

The known brush core, composed of cylindrical, segmental parts having a length equal to the length of the brush core, has to be manufactured very accurately to prevent fitting problems during mounting. Further for each application a core has to be manufactured with the desired length. So a very long element has to be extruded.

OBJECT OF THE INVENTION

The object of the present invention is to provide a composed brush core which is modified and improved such that it does not have the drawbacks described above. Further the improved brush core has to be put on the market in an economical responsible way.

SUMMARY OF THE INVENTION

To this end, according to the present invention, the brush core is improved further and is characterized in that the cylindrical inner wall and the cylindrical outer wall are coupled together by a pair types of ribs and that said outer wall has outwardly extending wall parts with connecting blocks on it for receiving said brush elements between them.

The advantage is a very flexible and robust manufactured brush core for placing the brush elements, whereby less fitting problems will occur during mounting.

Moreover the brush core according to the invention is improved further and characterized in that said pair of ribs between the cylindrical inner and outer wall consists of straight coupling ribs in alternate position with ribs with in the midst an opening with, preferably, a cylindrical shape.

The advantage is a robust coupling of the inner and outer wall, in which the ribs, with in its midst a, preferably, cylindrical opening, might be used for coupling the brush elements, which are divided in parts.

The brush core, according to the invention, is further developed in such a way, that it is characterized in that the means for coupling said double-walled segmental parts consist of thick-walled lips with zagzag shaped support surfaces which can be clamped onto each other by means of e.g. screw connections, which, preferably are completely taken up inside the inner and outer wall of the brush core.

The advantage is that a sufficient play can be obtained in the connection between the cylindrical segmental parts for a quick and problem free mounting.

BRIEF DESCRIPTION OF THE DRAWINGS

The invention is further elucidated on hand of a preferred embodiment shown in the drawing. In this shows.

DETAILED DESCRIPTION

Figure 1:
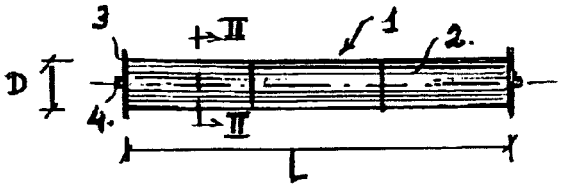
FIG. 1 a front view of the brush core according to the invention for further mounting to a brush machine.

In FIG. 1 a front view is shown of the mounted brush core 1 according to the invention with the length L. The brush core can be build up of cylindrical parts 2. By means of the end plates 3 and shaft 4 said brush core might be mounted to a brush machine (not shown).

Figure 2:
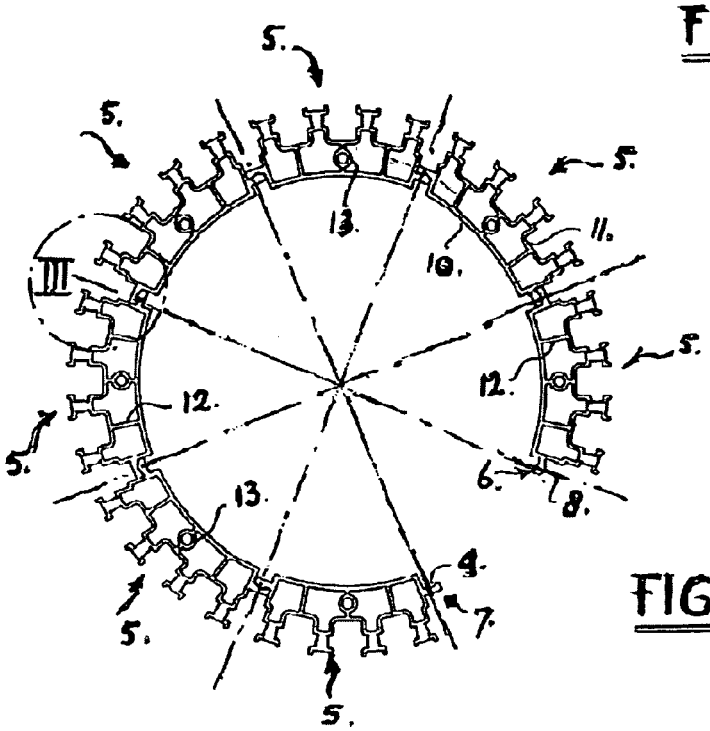
FIG. 2 a cross section of the brush core according to the invention, in which a double-walled segmental part is removed for indication of the design of the mutual connection.

For showing the way of mounting in FIG. 2 already seven double-walled segmental parts 5 are mounted. The mutual coupling of the double-walled segmental parts 5 takes place by means of thick-walled lips 6, 7 with mutual zigzag shaped support surfaces 8, 9. The inner wall 10 and the outer wall 11 are mutual coupled by straight coupling ribs 12 in alternate position with ribs with in its midst a cylindrical opening 13. The ribs with in its midst a cylindrical opening 13 can be used for mutual coupling cylindrical parts 2 (see FIG. 1) to (not shown) pins either rods.

Figure 3:
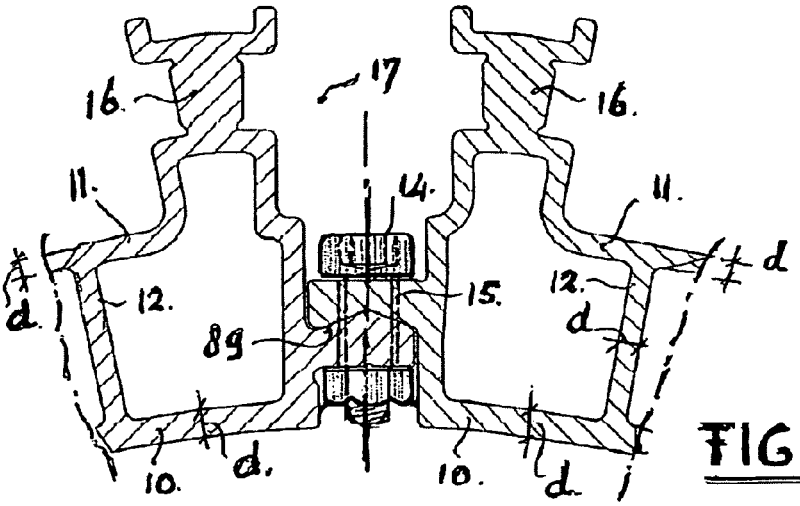
FIG. 3 a cross section of the detail III of the joining thick-walled lips for the mutual connection/mounting of the cylindrical segmental parts.

FIG. 3 shows the mutual coupling of the double-walled segmental parts 5 by means of a bold-nut connection 14 in a broad bore 15. In this the zagzag shaped support surfaces 8, 9 are also shown at a larger scale. Further the connecting blocks 16 for receiving the brush elements (not shown) in the room 17 between them are shown in detail. The robustness of the connecting blocks 16 offers a solid connection of the brush elements slid between them.

Finally it has to be remarked that a preferred embodiment of the invention is described above and that it is self-evident that further modifications are possible without leaving the scope of this patent specification.

The invention claimed is:

1. Brush core in the shape of a roller, being composed of double-walled segmental parts each having a cylindrical inner wall and a cylindrical outer wall and which after mounting form said roller, in which means are provided on a resulting outer surface for receiving brush elements, after which a cylindrical brush roller is obtained for mounting to a brush machine for brushing large surfaces, wherein said cylindrical inner wall and said cylindrical outer wall of each of said segmental parts are coupled together by two types of ribs and wherein said outer wall has outwardly extending wall parts with connecting blocks for receiving said brush elements therebetween, further comprising on each of said segmental parts thick-walled coupling lips projecting in a circumferential direction, said lips being formed with mating male and female zigzag surfaces facing in a radial direction.

2. Brush core according to claim 1, wherein said two types of ribs between the cylindrical inner and outer wall comprises straight coupling ribs and ribs with an opening.

3. Brush core according to claim 1, wherein the coupling lips are clamped onto each other by means of a screw connection, which is completely taken up inside the inner and outer wall of the brush core.

4. Brush core according to claim 3, wherein said bolt of said screw connection is a stainless steel bolt.

5. Brush core according to claim 1, wherein said connecting blocks are executed robustly for shape stability and for steady receiving of said brush elements.

6. Brush core according to the claim 1, wherein wall thicknesses of the inner and outer wall and of the two types of ribs are substantial equal to each other.

7. Brush core according to claim 6, wherein said thicknesses lie between 2 and 8 mm.

8. Brush core according to claim 1, wherein the inner diameter of the brush core lies between 300 and 500 mm and wherein the outer diameter lies between 500 and 1200 mm.

9. Brush core in the shape of a roller, being composed of double-walled segmental parts each having a cylindrical inner wall and a cylindrical outer wall and which after mounting form said roller, in which means are provided on a resulting outer surface for receiving brush elements, after which a cylindrical brush roller is obtained for mounting to a brush machine for brushing large surfaces, wherein said cylindrical inner wall and said cylindrical outer wall are coupled together by two types of ribs and wherein said outer wall has outwardly extending wall parts with connecting blocks for receiving said brush elements therebetween, said two types of ribs between the cylindrical inner and outer wall comprising straight coupling ribs and ribs with an opening, said ribs with an opening being located circumferentially between adjacent or consecutive ones of said connecting blocks.

10. Brush core according to claim 9, wherein said cylindrical brush roller with length L is composed of parts which are mutually connected by means of pins or rods in said ribs with openings.

11. Brush core according to any one the preceding claims, wherein the material of the extrudated brush core is aluminium.

* * * * *